US009199467B2

(12) United States Patent
Sai et al.

(10) Patent No.: US 9,199,467 B2
(45) Date of Patent: Dec. 1, 2015

(54) INK EJECTING PRINTER, INK EJECTING PRINTING SYSTEM, INK EJECTING PRINTER CONTROL METHOD, AND INK EJECTING PRINTER CONTROL PROGRAM

(71) Applicants: Noriyuki Sai, Kanagawa (JP); Kazuyoshi Matsumoto, Tokyo (JP); Soyoung Park, Kanagawa (JP)

(72) Inventors: Noriyuki Sai, Kanagawa (JP); Kazuyoshi Matsumoto, Tokyo (JP); Soyoung Park, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/519,254

(22) Filed: Oct. 21, 2014

(65) Prior Publication Data

US 2015/0116399 A1 Apr. 30, 2015

(30) Foreign Application Priority Data

Oct. 29, 2013 (JP) ..... 2013-223868

(51) Int. Cl.
*B41J 25/00* (2006.01)
*B41J 2/165* (2006.01)

(52) U.S. Cl.
CPC ..... *B41J 2/16511* (2013.01); *B41J 2/16526* (2013.01); *B41J 2/16585* (2013.01); *B41J 25/001* (2013.01)

(58) Field of Classification Search
CPC ..... B41J 2/14427; B41J 2002/041; B41J 2002/14443; B41J 29/02; B41J 2/16523; B41J 2/185; B41J 25/00; B41J 25/001
USPC ..... 347/90
See application file for complete search history.

(56) References Cited

U.S. PATENT DOCUMENTS 7,628,468 B2 * 12/2009 Silverbrook ..... 347/54

FOREIGN PATENT DOCUMENTS

| | | |
|---|---|---|
| JP | 4-371849 | 12/1992 |
| JP | 8-318623 | 12/1996 |
| JP | 2007-296802 | 11/2007 |

* cited by examiner

*Primary Examiner* — Thinh Nguyen
(74) *Attorney, Agent, or Firm* — Cooper & Dunham LLP

(57) ABSTRACT

An ink ejecting printer includes a recording head disposed with a prescribed clearance between the recording head and a recording medium having a predetermined length in a main scanning direction and ejects ink droplets onto the recording medium, a partitioning member longer than the recording head that has a predetermined width and can be moved between a position facing the recording head and a retracted position, a supporting member that supports the partitioning member movable between the position facing the recording head and the retracted position, a biasing unit that biases the supporting member toward the partitioning member is at the retracted position, a moving unit that moves the supporting member toward the partitioning member is at the position facing the recording head against the biasing unit, and a drive controller that moves the partitioning member to the position facing the recording head and performs dummy ejection at predetermined times.

10 Claims, 15 Drawing Sheets

| NUMBER OF DUMMY EJECTIONS | Tfire |
|---|---|
| 5 × n+1 | 14ms |
| 5 × n+2 | 20ms |
| 5 × n+3 | 25ms |
| 5 × n+4 | 29ms |
| 5 × n+5 | 33ms |

INK EJECTING PRINTER, INK EJECTING PRINTING SYSTEM, INK EJECTING PRINTER CONTROL METHOD, AND INK EJECTING PRINTER CONTROL PROGRAM

CROSS-REFERENCE TO RELATED APPLICATION

This patent application is based on and claims priority pursuant to 35 U.S.C. §119(a) to Japanese Patent Application No. 2013-223868, filed on Oct. 29, 2013 in the Japan Patent Office, the entire disclosure of which is hereby incorporated by reference herein.

BACKGROUND

1. Technical Field

The present invention relates to an ink ejecting printer, ink ejecting printing system, ink ejecting printer control method, and a non-transitory recording medium storing an ink ejecting printer control program.

2. Background Art

Ink ejecting printers such as inkjet printers are used for recording images on various recording media such as plain paper, roll paper, and film. Recently, ink ejecting printers are also used for recording images on thick recording media such as corrugated cardboard (including boxes).

There are two methods for ink ejecting printing. One is a so-called serial method, which records images by moving a recording head that includes nozzles in the main scanning direction and ejecting ink droplets to the recording medium. The other is a so-called line method, which records images by keeping a recording head that includes nozzles of recording width stationary while ejecting ink droplets on the recording medium.

Regarding the ink ejecting printers that record images on the thick recording media such as the corrugated cardboard, serial ink ejecting printers are not suitable since the recording medium is voluminous such as the corrugated cardboard and conveyed by conveyance units such as belt conveyors.

Therefore, regarding the ink ejecting printers that record images on the thick recording media such as the corrugated cardboard, the line ink ejecting printers are used conventionally.

The line ink ejecting printers include a recording head on which nozzles are formed over a recording length at least in the main scanning direction perpendicular to the conveyance direction of the thick recording medium such as the corrugated cardboard. The recording head is mounted on a supporting frame member installed on the belt conveyor (the conveyance unit) that transfers the recording medium such as the corrugated cardboard, and clearance between the recording head (i.e., the nozzles) and the recording medium such as the corrugated cardboard conveyed by the belt conveyor is ordinarily about 1 to 2 millimeters.

The ink ejecting printers perform dummy ejection appropriately to prevent nozzles from drying out or plugging up. In this case, the serial ink ejecting printers move the recording head to a position where a cap is located at a non-recording area in the main scanning direction and perform dummy ejection after capping the recording head with the cap.

However, line ink ejecting printers do not have a configuration that moves the recording head in the main scanning direction. Therefore, it is not possible to perform dummy ejection.

To cope with this issue, conventionally line ink ejecting printers perform dummy ejection during intervals between successive prints. In this case, basically, the line ink ejecting printers perform dummy ejection by moving a cap member that is long in the main scanning direction from a downstream side lower than a passing position of the recording medium toward the recording head and covering the recording head with the cap member.

SUMMARY

Example embodiments of the present invention provide a novel ink ejecting printer that includes a recording head disposed with a prescribed clearance between the recording head and disposed with a prescribed clearance between the recording head and a recording surface of a conveyed recording medium, has a predetermined recording length in the main scanning direction perpendicular to a conveyance direction of the recording medium, and ejects an ink droplet on the recording surface, a partitioning member that is longer than the recording length of the recording head, has a predetermined width in the conveyance direction and can move from a position facing the recording head to a retracted position away from the position facing the recording head and vice versa in parallel with the recording surface between the recording head and the recording surface, a supporting member that supports the partitioning member movable between the position facing the recording head and the retracted position, a biasing unit that biases the supporting member toward the partitioning member is located at the retracted position, a moving unit that moves the supporting member toward the partitioning member is located at the position facing the recording head against biasing force of the biasing unit, and a drive controller that moves the partitioning member to the position facing the recording head by driving the moving unit and instructs the recording head to eject an ink droplet on the partitioning member by performing dummy ejection by driving the recording head at predetermined drive timing.

Further example embodiments of the present invention provide an ink ejecting printing control method, and a non-transitory recording medium storing an ink ejecting printing control program.

BRIEF DESCRIPTION OF THE DRAWINGS

A more complete appreciation of the disclosure and many of the attendant advantages thereof will be readily obtained as the same becomes better understood by reference to the following detailed description when considered in conjunction with the accompanying drawings.

DETAILED DESCRIPTION

Figure 1:
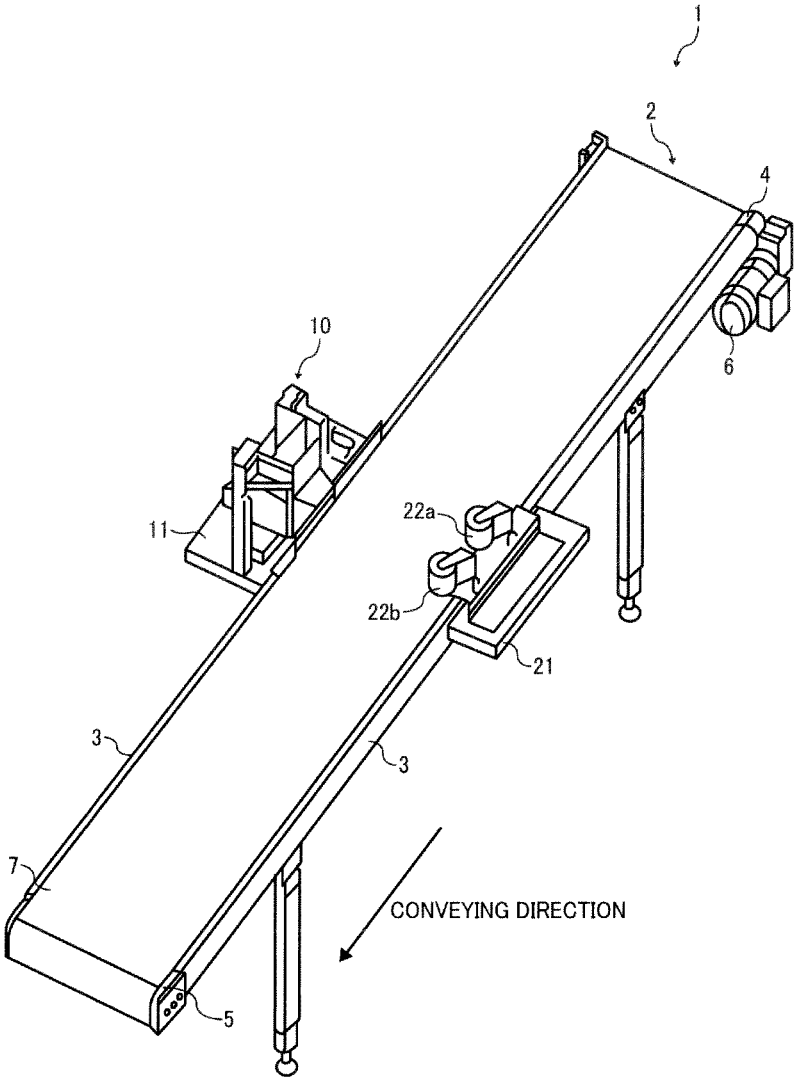
FIG. 1 is a schematic perspective diagram illustrating an inkjet printing system as an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In the conventional technologies described above, the line ink ejecting printer performs dummy ejection by moving a cap member that is long in the main scanning direction from downstream side lower than a passing position of the recording medium toward the recording head and covering the recording head with the cap member. However, this dummy ejection method cannot handle thick recording media such as corrugated cardboard.

That is, in the ink ejecting printer that records an image on the thick recording medium such as the corrugated cardboard built in box-shape), the recording medium is conveyed by the conveyance unit such as the belt conveyor, and the ink ejecting printer is mounted on the conveyance unit detachably. The ink ejecting printer records an image by ejecting ink droplets on the recording medium conveyed by the conveyance unit on which the ink ejecting printer is mounted. In addition, clearance between the recording head and the recording medium is set narrow, i.e., from 1 mm to 2 mm normally, in order to achieve high image quality. Therefore, it is difficult to create the gap where the cap member is housed on the transferring member such as the belt conveyor of the conveyance unit, move the cap member to a position nearby the recording head, perform the dummy ejection, and move the cap member back to the gap. In order to move the cap member in the way described above, it is necessary to stop the conveyance unit such as the belt conveyor transferring temporarily, perform the dummy ejection, and drive the conveyance unit again. That degrades the work efficiency.

In the following embodiment, an inkjet printer that performs the dummy ejection of the recording head that ejects ink droplets on the thick recording medium quickly at appropriate timing is provided.

First Embodiment

The first embodiment is described below with reference to from FIG. 1 to FIG. 12. FIG. 1 is a schematic perspective diagram illustrating an inkjet printing system 1 in the first embodiment.

In FIG. 1, in the inkjet printing system (ink ejecting printing system) 1, a belt conveyor 2 is supported by legs 3 and located at predetermined height from a floor. The belt conveyor (conveyance unit) 2 has a predetermined width and includes a frame member 3 longer than width in the conveyance direction (the arrow direction in FIG. 1), a driving roller 4 and a driven roller 5 supported by the frame member 3 rotatably on both ends in the conveyance direction, a guide roller or a guide plate laid out between the driving roller 4 and the driven roller 5, a driving motor 6 that drives the driving roller 4, and a transferring belt 7 that bridges the driving roller 4 and the driven roller 5 and moves endlessly.

The belt conveyor 2 transfers the transferring belt 7 in the conveyance direction as predetermined transferring velocity by driving by the driving motor 6. In the belt conveyor 2, for example, a corrugated cardboard box as a thick recording medium Pb (shown in FIG. 4) is put on the transferring belt 7, and the belt conveyor 2 transfers the recording medium Pb at predetermined transferring velocity.

Figure 2:
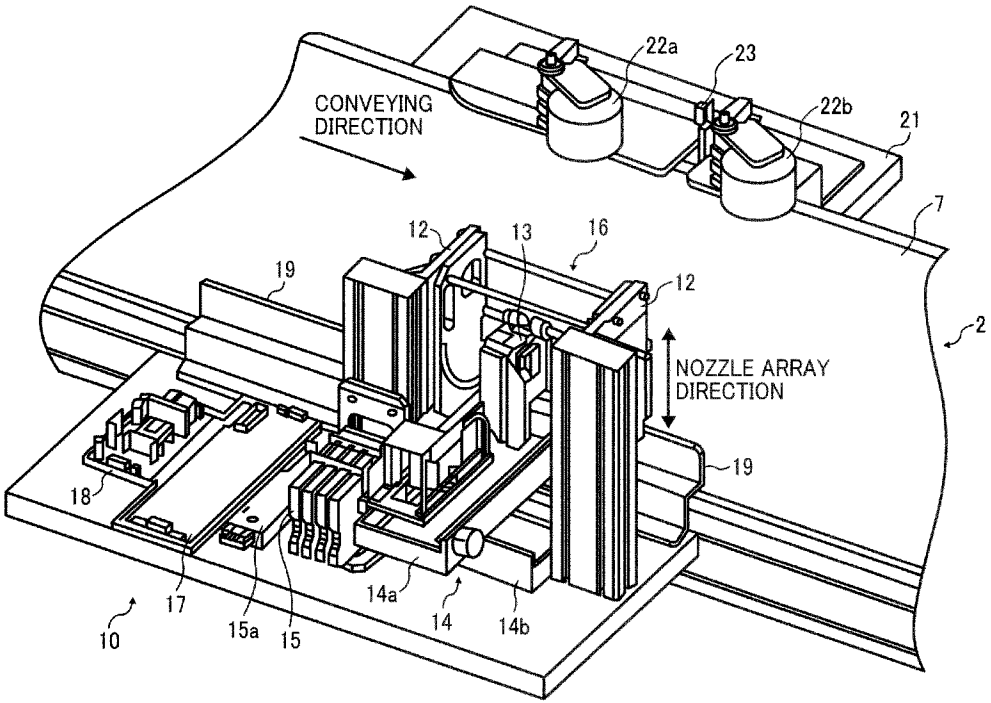
FIG. 2 is an enlarged diagram illustrating an inkjet printer as an embodiment of the present invention.

In the inkjet printing system 1, an inkjet printer (ink ejecting printer) 10 is laid out on the way in the conveyance direction of the belt conveyor 2. As shown in FIG. 2, the inkjet printer 10 is mounted on the frame member 3 that faces with each other sandwiching the transferring belt 7 of the belt conveyor 2 separately. In the inkjet printer 10, a base 11 is mounted on the frame member 3 on one end of the belt conveyor 2, and a supporting arm 12, a carriage 13, a moving unit 14, ink cartridges 15, a maintenance unit 16, a controller 17, a power supply 18, and a guide fence 19 etc. are mounted on the base 11. In addition, in the inkjet printer 10, a base 21 is mounted on the frame member 3 on the other end of the belt conveyor 2, and a pair of pressing rollers 22*a* and 22*b* and a recording medium detection sensor 23 are mounted on the base 21.

The supporting arm 12 is mounted on the base 11 and supports the carriage 13 movably in the vertical direction and the conveyance direction.

The carriage 13 holds a recording head 13*a* (shown in FIGS. 3, 4, and 7) on which multiple nozzles 13*n* (shown in FIGS. 3 and 7) are formed on the side of the transferring belt 7. In the recording head 13*a*, lots of nozzles 13*n* are laid out along in the nozzle array direction shown in FIG. 2 (vertical to the transferring surface of the transferring belt 7 and each of the nozzles 13*n* ejects an ink droplet selectively at appropriate ejecting velocity. On the recording head 13*a* that the carriage 13 holds, the nozzles 13*n* that can perform printing (recording) on the recording medium Pb that passes on the transferring belt 7 at one ink ejection at maximum printing width in the nozzle array direction are laid out in the nozzle array direction. In the recording head 13*a*, the nozzles 13*n* for one color are laid out as the nozzle array if the inkjet printer 10 records an image with one color only. If the inkjet printer 10 records an image with multiple color inks, the nozzles 13*n* for those colors are laid out as the nozzle array.

The moving unit 14 moves in the width direction parallel to the conveyance direction and the transferring surface of the transferring belt 7 and perpendicular to the conveyance direction. That is, the moving unit 14 includes a width direction moving unit 14*a* and a conveyance direction moving unit 14*b* and moves the carriage 13 supported by the supporting arm 12 in the width direction and the conveyance direction by the width direction moving unit 14*a* and the conveyance direction moving unit 14*b*. The carriage 13 moves to the direction vertical to the width direction, the conveyance direction and the transferring belt 7 by the moving unit 14 and the supporting arm 12.

The replaceable ink cartridge 15 is housed in a cartridge housing unit (not shown in figures) laid out on the base 11 and supplies ink to the nozzles 13*n* in the recording head 13*a* via an ink tube (not shown in figures). The ink cartridge 15 includes a collection tank 15*a* that contains waste ink.

As described later, the controller 17 controls the whole part of the inkjet printer 10, prints an image on the thick recording medium Pb, and performs the control method of the ink ejecting printing that performs the dummy ejection appropriately in the present invention.

The power supply 18 generates electrical power in voltages and currents necessary for the inkjet printer 10 to operate from commercial power supplied via the power cord and supplies them to each unit in the inkjet printer 10, The guide fence 19 determines a position of the recording medium Pb conveyed on the transferring belt 7 against the recording head 13*a*.

In the pressing rollers 22*a* and 22*b*, the rollers are supported rotatably by an arm, and the arm is mounted on a mounting unit of the base 21 parallel to the surface of the transferring belt 7 in the width direction of the transferring belt 7. The pressing rollers 22*a* and 22*b* presses the recording medium Pb conveyed on the transferring belt 7 by the transferring belt 7 to the guide fence 19 and transfers the recording medium Pb to the position facing to the recording head 13*a* while the recording medium Pb is cohered to the guide fence 19.

The recording medium detection sensor 23 detects the recording medium Pb conveyed on the transferring belt 7 to the inkjet printer 10 by the belt conveyor 2.

Figure 3:
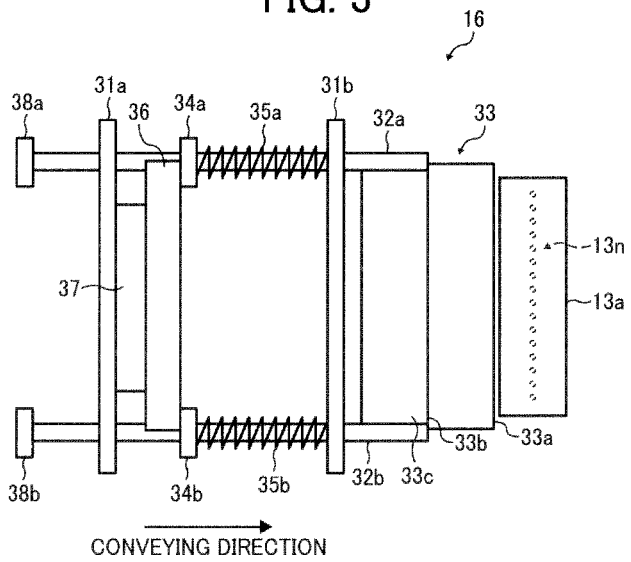
FIG. 3 is a plain diagram illustrating a maintenance unit as an embodiment of the present invention.
Figure 4:
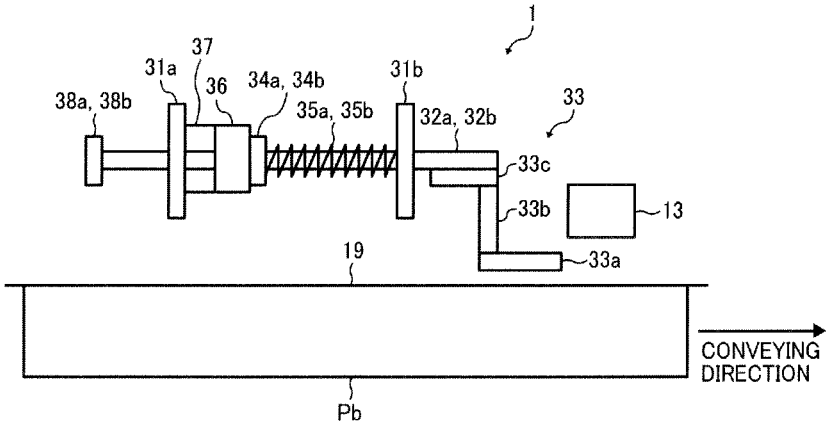
FIG. 4 is an elevational diagram illustrating the maintenance unit as an embodiment of the present invention.

The maintenance unit 16 performs capping to maintain and recover printing performance of the nozzles 13*n* in the recording head 13*a* and receives ink in performing the dummy ejection. As shown in FIGS. 3 and 4, in the maintenance unit 16, a pair of axis fixing members 31*a* and 31*b* are mounted on the supporting arm (supporting member) 12 being separated at predetermined interval in the conveyance direction of the recording medium Pb. As shown in FIG. 3, the axis fixing members 31*a* and 31*b* are longer than the recording head 13*a* and mounted in parallel. Through holes (not shown figures) are formed on both ends of the axis fixing members 31*a* and 31*b*. The axis fixing members 31*a* and 31*b* supports the supporting arms 32*a* and 32*b* movably in the sub-scanning direction (perpendicular to the main scanning direction as the nozzles 13*n* direction), i.e., in the reverse conveyance direction of the recording medium Pb by going the supporting arms 32*a* and 32*b* through the through holes. In the supporting arms 32*a* and 32*b*, a partitioning plate (partitioning member) 33 is mounted on its edge in the recording head 13*a* side, and the partitioning plate 33 is mounted bridging the edge of the supporting arm 32*a* and the edge of the supporting arm 32*b*. As shown in FIG. 4, the partitioning plate 33 has a substantially Z-shaped form and includes an ink receiving plate 33*a*, a connecting plate member 33*b*, and a fixing plate member 33*c*. In the partitioning plate 33, the fixing plate member 33*c* is mounted on the supporting arms 32*a* and 32*b* on the side of the recording member Pb. In the partitioning plate 33, the connecting plate member 33*b* extends in the direction from the supporting arms 32*a* and 32*b* to the recording medium Pb, and the ink receiving plate member (partitioning member) 33*a* is located in the middle position of the recording medium Pb and the recording head 13 as shown in FIG. 4. In the partitioning plate 33, the supporting arms 32*a* and 32*b* are supported so as to be movable in the conveyance direction and the reverse conveyance direction. Therefore, the partitioning plate 33 can move to a position facing the recording head 13*a* between the recording head 13*a* and the recording medium Pb and a retracted position that retracts in the reverse conveyance direction from the position facing the recording head.

In the supporting arms 32*a* and 32*b*, a receiving members 34*a* and 34*b* are mounted between the axis fixing members 31*a* and 31*b* and near the axis fixing member 321. The supporting arms 32*a* and 32*b* are laid out between the receiving members 34*a* and 34*b* and the axis fixing member 31*b* binding compression coil springs 35*a* and 35*b*. The compression coil springs (biasing unit) 35*a* and 35*b* biases the ink receiving plate member 33*a* of the partitioning plate 33 to the direction located at the retracted position by biasing the receiving members 34*a* and 34*b* in the direction away from the axis fixing member 31*b*.

In the receiving members 34*a* and 34*b*, a permanent magnet 36 is mounted on the side facing to the axis fixing member 31*a*, and the permanent magnet 36 is mounted so that its SN axis direction corresponds to the axis direction of the supporting arms 32*a* and 32*b*.

On the side of the axis fixing member 31*a* facing to the axis fixing member 31*b*, an electromagnet 37 is laid out between the supporting arms 32*a* and 32*b*. The electromagnet (moving unit) 37 generates magnetic poles by turning on electricity, and the electromagnet 37 is laid out so that its SN axis direction of the magnetic poles corresponds to the axis direction of the supporting arms 32*a* and 32*b* and the magnetic poles on the surface facing to the permanent magnet 36 correspond to the magnetic poles of the permanent magnet 36. Therefore, the electromagnet 37 generates repulsive force against the permanent magnet 36 by turning on electricity and moves the supporting arms 32*a* and 32*b* on which the receiving member 34*a* and 34*b* are mounted to the conveyance direction against the biasing power of the compression coil springs 35*a* and 35*b*. Consequently, the electromagnetic (moving unit) 37 moves the ink receiving plate member 33*a* of the partitioning plate 33 to the position facing the recording head described above by turning on electricity via the receiving members so 34*a* and 34*b* and supporting arms 32*a* and 32*b*, In the supporting arms 32*a* and 32*b*, stoppers 38*a* and 38*b* are mounted on an end opposite to the partitioning plate 33 that goes though the through hole of the axis fixing member 31*a*. The stoppers 38*a* an 38*b* are mounted in a position that prevents the connecting plate 33*b* of the partitioning plate 33 from colliding with the recording head 13*a* when the supporting arms 32*a* and 32*b* move to the direction of the recording head 13*a* after the electromagnetic 37 is turned on electricity.

Figure 5:
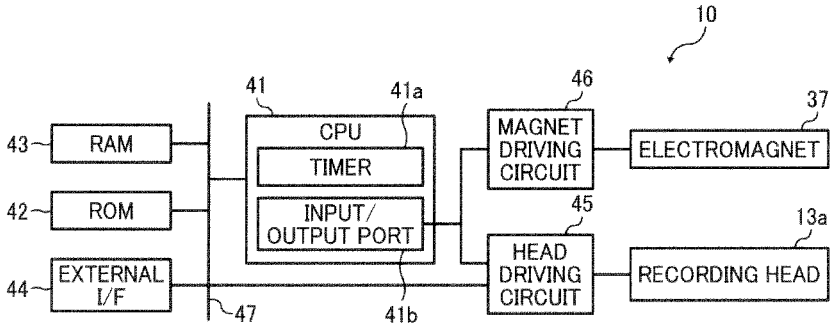
FIG. 5 is a block diagram illustrating a substantial part of the inkjet printer as an embodiment of the present invention.

As shown in FIG. 5, the substantial parts of the inkjet printer 10 are configured in blocks, and a Central Processing Unit (CPU) 41, a Read Only Memory (ROM) 42, a Random Access Memory (RAM) 43, an external I/F 44, a head driving circuit 45, a magnetic driving circuit 46, the electromagnet 37, and the recording head 13*a* etc. are included. The CPU 41 includes a timer 41*a* and an input/output port 41*b*, and the CPU 41, the ROM 42, the ROM 43, the external I/F 44, and the head driving circuit 45 are connected with each other via a bus 47.

The ROM 42 stores a base program of the inkjet printer 10, an inkjet ejecting printing control program (described later), and data necessary for executing each program preliminarily. Especially, the ROM 42 stores drive timing for the recording head 13*a* that performs dummy ejection of the recording head 13*a* that ejects ink droplets on the thick recording medium Pb quickly at appropriate timing in table format for example.

The CPU (drive controller) 41 utilizes the RAM 43 as a work memory based on the program stored in the ROM 42, controls each unit in the inkjet printer 10, executes a basic sequence as the inkjet printer 10, and performs the ink ejecting printing control method described later.

That is, the inkjet printer 10 is constructed as the ink ejecting printer that performs dummy ejection of the recording head 13*a* that ejects ink droplets on the thick recording medium Pb quickly at appropriate timing (described later) by reading an ink ejecting printing control program to execute an ink ejecting printing control method of the present invention stored in a computer-readable medium such as a ROM, Electrically Erasable and Programmable Read Only Memory (EEPROM), EPROM, flash memory, flexible disk, Compact Disc Read Only Memory (CD-ROM), Compact Disc Rewritable (CD-RW), Digital Versatile Disk (DVD), Secure Digital (SD) card, and Magneto-Optical disc (MO) etc. and install it in the ROM 42 etc., and the inkjet print system 1 is constructed as an ink ejecting printing system that includes the inkjet printer 10. The ink ejecting printing control program is a computer-executable program written in legacy programming language and object oriented programming language such as assembler, C, C++, C#, and Java etc. and can be distributed being stored in the recording medium described above.

After the recording medium detection sensor 23 detects the recording medium Pb or its edge, the CPU 41 controls the recording head 13*a* by the head driving circuit 45 to instruct to record an image on the recording medium Pb conveyed being pressed to the guide fence 19 by the pressing rollers 22*a* and 22*b*. As described later, the CPU 41 performs an ink ejecting printing control process that performs dummy ejection quickly by controlling the magnet driving circuit 46 and the head driving circuit 45 at appropriate timing such as an interval between recording an image on the recording medium Pb etc. That is, the CPU 41 expands image data taken from outside via the external I/F 44 into a driving signal in data format usable by the head driving circuit 45 using the RAM 43 and passes the driving signal to the head driving circuit 45. The head driving circuit 45 drives the recording head 13*a* based on the driving signal. In addition, the CPU 41 controls drive timing of the magnet driving circuit 46 and the head driving circuit 45 based on the dummy ejection period time timed by the timer 41*a* and timing of dummy ejection.

The RAM 43 is used as a work memory of the CPU 41, and a program read from the ROM 42 and various variables are expanded in the RAM 43. Especially, data such as timing of dummy ejection used in the ink ejecting printing control process that performs dummy ejection quickly of the present invention described later is stored in the RAM 43 by the CPU 41.

The timer 41*a* includes an oscillator and a frequency demultiplier, etc. and times current time and preset time.

The input/output port 41*b* is connected to the head driving circuit 45 and the magnet driving circuit 46 and exchanges signals with the head driving circuit 45 and the magnet driving circuit 46.

The CPU 41 drives the magnet driving circuit 46 and the head driving circuit 45 via the input/output port 41*b* based on timing of dummy ejection timed by the timer 41*a* and controls dummy ejection.

The head driving circuit 45 is connected to the input/output port 41*b* in the CPU 41 and the bus 47, drives the recording head 13*a* to eject ink droplets in a driving state in accordance with the driving signal, and instructs the recording head 13*a* to perform dummy ejection of all nozzles 13*n* based on a dummy ejection signal from the input/output port 41*b*.

The magnet driving circuit 46 is connected to the input/output port 41*b* in the CPU 41 and controls driving/stopping the electromagnet 37 by turning on/off electricity to the electromagnet 37 in the maintenance unit 16.

Next, an operation of this embodiment is described. The inkjet printer 10 in this embodiment performs dummy ejection of the recording head 13*a* that ejects ink droplets on the thick recording medium Pb quickly at appropriate timing.

In the inkjet printing system 1, it is necessary to perform dummy ejection of the recording head 13*a* in an appropriate period so that the inkjet printer 10 can perform printing with good image quality.

The inkjet printer 10 includes a maintenance unit 6 that receives ink droplets in performing dummy ejection by the recording head 13*a*. In the maintenance unit 16, the ink receiving plate 33*a* moves between the position facing the recording head and the retracted position by the repulsive force of the electromagnetic 37 and the biasing force of the compression coil springs 35*a* and 35*b*.

That is, in the maintenance unit 16, the ink receiving plate 33*a* is biased in the direction moving from the position facing the recording head to the retracted position by the biasing force of the compression coil springs 35*a* and 35*b*. In the maintenance unit 16, after the electromagnet 37 is turned on electricity and driven, the repulsive force is provided to the permanent magnet 36 in the direction that the ink receiving plate 33*a* of the partitioning plate 33 moves from the retracted position to the position facing the recording head against the biasing force of the compression coil spring 35. The supporting arms 32*a* and 32*b* that the partitioning plate 33 is mounted prevents the connecting board 33*b* of the partitioning plate 33 from colliding with the recording head 13*a* by making the stoppers 38*a* and 38*b* contact with the axis fixing member 31*a* and locates the ink receiving plate 33*a* at the position facing the recording head. In the maintenance unit 16, after the electromagnet 37 is turned off electricity and not driven, the ink receiving plate 33*a* of the partitioning plate 33 moves (recovers) from the position facing the recording head to the retracted position along with the supporting arm 32*a* and the 32*b* by the biasing power of the compression coil spring 35.

In the inkjet printer 10, while the ink receiving plate 33*a* of the maintenance unit 16 is located at the position facing the recording head 13*a*, the recording head 13*a* is driven to perform dummy ejection. That is, the ink receiving plate 33*a* has a predetermined width in the conveyance direction and is located at the position facing the recording head 13*a* during predetermined period even when the ink receiving plate 33*a* is moving.

In the inkjet printing system 1, usually, the gap between the recording head 13*a* and the recording medium Pb is about 1 mm to 2 mm. Therefore, in the inkjet printing system 1, in case of performing dummy ejection at the same position on the ink receiving plate 33*a*, ink droplets due to dummy ejection is piled up on the side of the ink receiving plate 33*a* facing to the recording head 13*a*, and the ink touches the recording head 13*a*. As a result, that results in proceeding stopping up the nozzles in the recording head 13*a* contrarily, and it is possible to degrade the image quality.

To cope with this issue, in the inkjet printer 10 in the present embodiment, timing of dummy ejection at the position facing the recording head where the ink receiving plate 33*a* faces to the recording head 13*a* is changed appropriately, and it is prevented that the ink droplets due to dummy ejection are ejected at the same spot and piled up.

That is, as shown in FIG. 5, the CPU 41 performs dummy ejection of the recording head 13*a* between printouts. After finishing the printing operation on the recording medium Pb and transitioning to the dummy ejection operation, the CPU 41 first turns on electricity to the electromagnet 37 via the magnet driving circuit 46. During the "on time" $T_{on}$, the CPU 41 moves the ink receiving plate 33*a* of the partitioning plate 33 to the position facing the recording head via the supporting arms 32*a* and 32*b* using the repulsive force of the electromagnet 37 against the biasing force of the compression coil spring 35 until the stoppers 38*a* and 38*b* contact with the axis fixing member 31*a*. Enough time for the stoppers 38*a* and 38*b* contact with the axis fixing member 31*a* is preset to the "on time" $T_{on}$ and stored in the ROM 42 etc. The CPU 41 reads the "on time" $T_{on}$ and drives the electromagnet 37 turning on via the magnet driving circuit 46. That is, in case of being located at the standby position as shown in FIG. 7A, after the electromagnet 37 is turned on, the ink receiving plate 33*a* moves to the retracted position by the repulsive forces by the electromagnet 37 and the permanent magnet 36 as shown in FIG. 7B.

Next, the CPU 41 turns off electricity to the electromagnet 37 via the magnet driving circuit 46. While the ink receiving plate 33*a* is located at the position facing the recording head 13*a* in the "off time" $T_{off}$, the CPU 41 instructs all nozzles 13*n* in the recording head 13*a* to perform dummy ejection. The number of this dummy ejection operation is not limited to once and not limited as far as during the period while the ink receiving plate 33*a* faces to the recording head 13*a* and the ink receiving plate 33*a* can receive ink droplets due to dummy ejection. After the electromagnet 37 is turned off electricity, the ink receiving plate 33*a* moves to the retracted position where the permanent magnet 36 mounted on the receiving members 34*a* and 34*b* contacts with the electromagnet 37 by the biasing force of the compression coil springs 35*a* and 35*b*.

In the above description, the CPU 41 performs dummy ejection at the position facing the recording head on the way of homeward moving from the position facing the recording head to the retracted position. The reason why dummy ejection is performed at the position facing the recording head where the ink receiving plate 33*a* faces to the recording head 13*a* not on the way of outward but on the way of homeward is described below.

Figure 6:
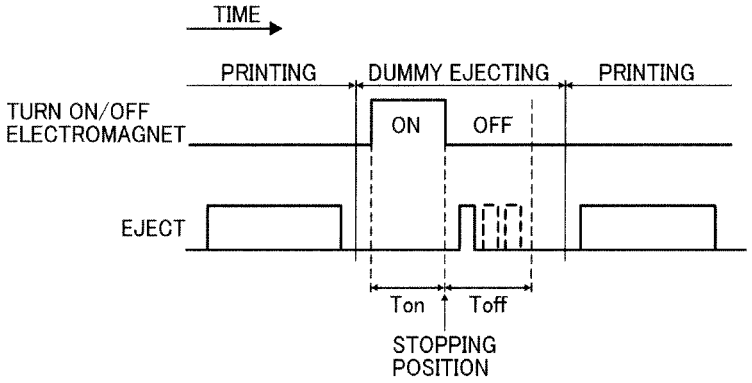
FIG. 6 is a timing chart illustrating dummy ejection as an embodiment of the present invention.
Figure 7:
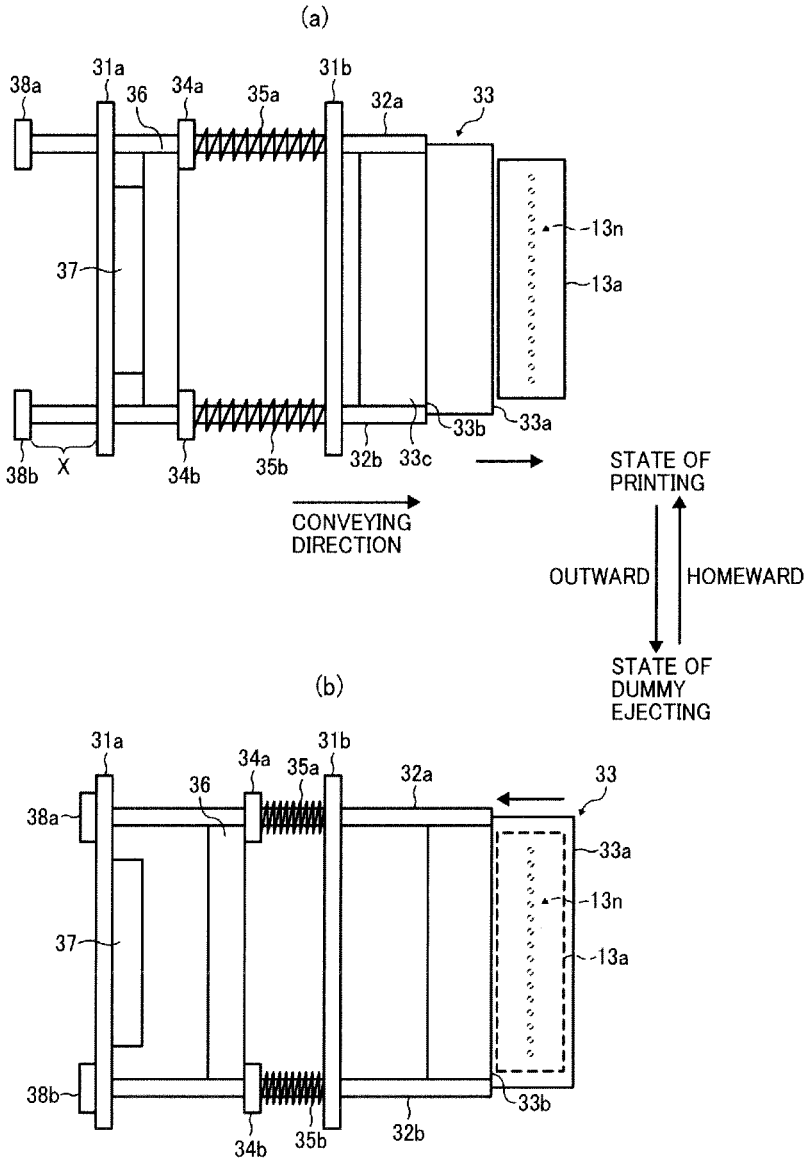
FIG. 7 is a diagram illustrating a moving state of an ink receiving plate as an embodiment of the present invention.

That is, in the maintenance unit 16, on the way of outward, the ink receiving plate 33*a* is moved to the position facing the recording head by the repulsive force of the electromagnet 37 against the permanent magnet 36 against the compressing force of the compression coil springs 35*a* and 35*b*. As a result, since the two forces act with each other and the repulsive force by the electromagnet 37 is high speed, it is difficult to calculate time when the ink receiving plate 33*a* faces to the recording head 13*a* and dummy ejection can be performed accurately. By contrast, since the maintenance unit 16 moves to the position facing the recording head to the retracted position by the biasing force of the compression coil springs 35*a* and 35*b* on the way of homeward, it is possible to calculate time when the maintenance unit 16 is located at the position facing the recording head easily from elastic motion of the compression coil springs 35*a* and 35*b* only after starting moving from the stopping position by the stoppers 38*a* and 38*b*. That is, in moving from the stopping position to the retracted position, due to the compression coil springs 35*a* and 35*b* only and accelerated motion from zero velocity, it is possible to calculate positional relationship between the ink receiving plate 33*a* and the recording head 13*a* accurately compared to outward. As a result, the CPU 41 instructs the recording head 13*a* to perform dummy ejection at the timing the ink receiving plate 33*a* faces to the recording head 13*a* appropriately on the way of homeward that the receiving plate 33*a* moves from the position facing the recording head to the retracted position. That is, the CPU 41 configures appropriate timing during period when the electromagnet 37 shown in FIG. 6 is turned off electricity and the ink receiving plate 33*a* is located at the position facing the recording head where the ink receiving plate 33*a* faces to the recording head 13*a* as timing of dummy ejection. For example, in case of performing dummy ejection only once, the CPU 41 instructs the recording head 13*a* to perform dummy ejection at timing shown as ejecting pulses in solid lines and dashed lines in FIG. 6.

Figures 8, 9:
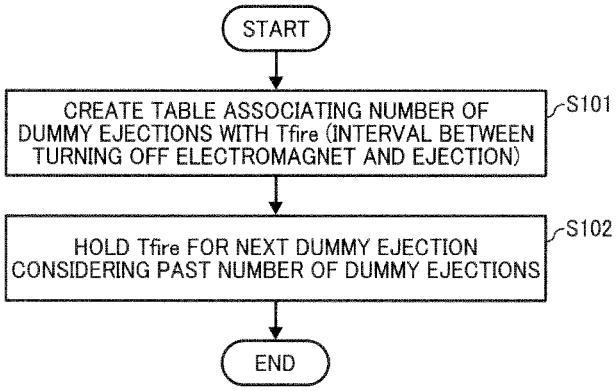
FIG. 8 is a flowchart illustrating a process of configuring dummy ejection time as an embodiment of the present invention.
FIG. 9 is a diagram illustrating a dummy ejection table as an embodiment of the present invention.

For example, here, it is assumed that dummy ejecting position is selected from five dummy ejection positions each time performing dummy ejection. As shown in FIG. 8, each time the inkjet printer 10 is turned on, the CPU 41 performs a dummy ejection time configuration process that generates a dummy ejection table Tb1 (shown in FIG. 9) associated with the number of dummy ejection and dummy ejection start time $T_{fire}$. Subsequently, in case of performing dummy ejection actually, the CPU 41 reads the dummy ejection start time $T_{fire}$ with reference to the dummy ejection table Tb1 based on the number of dummy ejections and instructs the recording head 13*a* to perform dummy ejection at the dummy ejection start time $T_{fire}$.

That is, after the inkjet printer 10 is turned on, the CPU 41 performs the dummy ejection time configuration process shown in FIG. 8. The CPU generates the dummy ejection table Tb1 (shown in FIG. 9) associated with the number of dummy ejections and the dummy ejection start time $T_{fire}$ in S101. In the dummy ejection table Tb1, the dummy ejection start time $T_{fire}$ when dummy ejection is performed at different positions on the ink receiving plate 33 each time the dummy ejection is performed I configured. In FIG. 9, "n" indicates the past number of dummy ejections, and the dummy ejection start time $T_{fire}$ indicates elapsed time from the stopping position after the electromagnet 37 is turned off and time when dummy ejection is started performing.

After generating the dummy ejection table Tb1, the CPU 41 acquires the dummy ejection start time $T_{fire}$ for the next dummy ejection from the dummy ejection table Tb1 using the number of past dummy ejections, stores the dummy ejection start time $T_{fire}$ for the next dummy ejection in the RAM 43, and finishes the dummy ejection time configuration process in S102.

Figure 10:
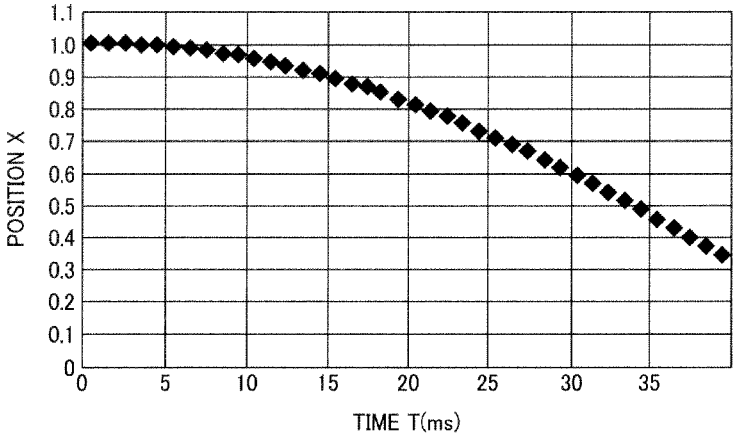
FIG. 10 is a diagram illustrating relationship between elapsed time from a stopping position and a dummy ejection position as an embodiment of the present invention.

That is, the relationship between the elapsed time T from the stopping position after the electromagnet 37 is turned off and the position X where dummy ejection is performed on the ink receiving plate 33*a* is illustrated in FIG. 10. In FIG. 10, the position X indicates the position whose origin is the edge position of the ink receiving plate 33*a* in the transferring side, and the time T indicates the elapsed time after the electromagnet 37 is turned off.

Figure 11:
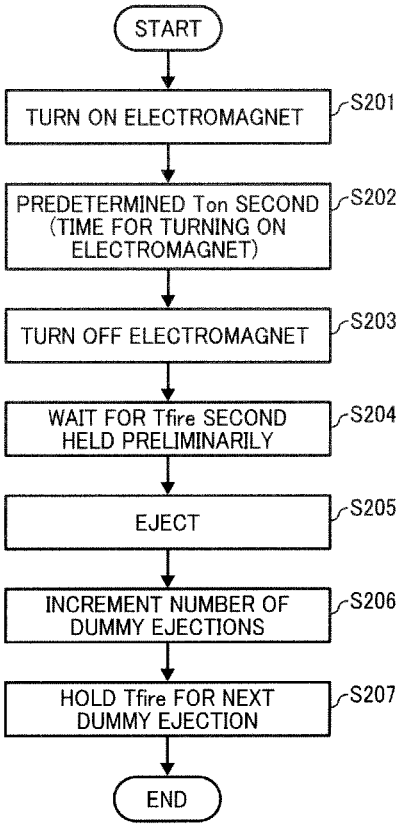
FIG. 11 is a flowchart illustrating a process of controlling dummy ejection as an embodiment of the present invention.

In dummy ejection, the CPU 41 performs the dummy ejection control process as shown in FIG. 11. That is, the CPU 41 first turns the electromagnet 37 on at timing of dummy ejection in S201 and keeps the electromagnet 37 turned on during the preset "on time" $T_{on}$ in S202. The "on time" $T_{on}$ indicates time for moving the ink receiving plate 33*a* from the standby position to the stopping position as the position facing the recording head certainly by turning the electromagnet 37 on, and the preset "on time" $T_{on}$ is stored in the ROM 42 etc. After turning the electromagnet 37 on for the "on time" $T_{on}$, the CPU 41 turns the electromagnet 37 off in S203 and waits the preset dummy ejection start time $T_{fire}$ elapse in S204.

After the electromagnet 37 is turned off and the dummy ejection start time $T_{fire}$ elapses, the CPU 41 performs dummy ejection by driving the recording head 13*a* in S205.

Next, in order to set the position of the next dummy ejection different from the position of the current dummy ejection, the CPU 41 increments the number of dummy ejections by one in S206. The CPU 41 reads the dummy ejection start time $T_{fire}$ for the next dummy ejection from the dummy ejection table Tb1 and stores it in the RAM 43 in S207. Consequently, the dummy ejection control process ends.

As described above, in the inkjet printing system 1 in this embodiment, the inkjet printer 10 is laid out creating predetermined clearance against the recording surface of the conveyed recording medium Pb. The inkjet printer 10 includes the recording head 13*a* that has a predetermined recording length in the main scanning direction perpendicular to the conveyance direction of the recording medium Pb, the partitioning plate (partitioning member) 33 that is longer than the recording length of the recording head 13*a* and has a predetermined width in the conveyance direction and can be moved in parallel with the recording surface between the position facing the recording head 13*a* and the retracted position away from the position facing the recording head, the supporting arms (supporting member) 32*a* and 32*b* that supports the ink receiving plate 33*a* of the partitioning plate 33 movable between the position facing the recording head and the retracted position, the compression coil springs (biasing units) 35*a* and 35*b* that biasing the supporting arms 32*a* and 32*b* to the retracted position where the ink receiving plate 33*a* of the partitioning plate 33 is located at the retracted position, the electromagnet (moving unit) 37 that moves the supporting arms 32*a* and 32*b* to the position where the ink receiving plate 33*a* of the partitioning plate 33 is located at the position facing the recording head against the biasing force exerted by the compression coil springs 35*a* and 35*b*, and the CPU (drive controller) 41 that moves the ink receiving plate 33*a* of the partitioning plate 33 to the position facing the recording head by driving the electromagnet 37 and instructs to perform dummy ejection against the ink receiving plate 33*a* of the partitioning plate 33 by driving the recording head 13*a* at the predetermined drive timing.

Consequently, it is possible to move the ink receiving plate 33*a* of the partitioning plate 33 to the gap between the recording surface of the thick recording medium Pb and the recording head 13*a* at timing of dummy ejection and instruct the recording head 13*a* to perform dummy ejection. As a result, it is possible to perform dummy ejection of the recording head 13*a* that ejects ink droplets on the thick recording medium Pb quickly at appropriate timing.

The inkjet printing system 1 includes the belt conveyor (conveyance unit) 2 that transfers the thick recording medium Pb at constant velocity and the inkjet printer (ink ejecting printer) 10 that records an image by ejecting ink droplets in a stationary state. The inkjet printer 10 is laid out creating predetermined clearance against the recording surface of the conveyed recording medium Pb. The inkjet printer 10 includes the recording head 13*a* that has a predetermined recording length in the main scanning direction perpendicular to the conveyance direction of the recording medium Pb, the partitioning plate (partitioning member) 33 that is longer than the recording length of the recording head 13*a* and has a predetermined width in the conveyance direction and can be moved in parallel with the recording surface between the position facing the recording head 13*a* and the retracted position away from the position facing the recording head, the supporting arms (supporting member) 32*a* and 32*b* that supports the ink receiving plate 33*a* of the partitioning plate 33 movable between the position facing the recording head and the retracted position, the compression coil springs (biasing units) 35*a* and 35*b* that biasing the supporting arms 32*a* and 32*b* to the retracted position where the ink receiving plate 33*a* of the partitioning plate 33 is located at the retracted position, the electromagnet (moving unit) 37 that moves the supporting arms 32*a* and 32*b* to the position where the ink receiving plate 33*a* of the partitioning plate 33 is located at the position facing the recording head against the biasing force by the compression coil springs 35*a* and 35*b*, and the CPU (drive controller) 41 that moves the ink receiving plate 33*a* of the partitioning plate 33 to the position facing the recording head by driving the electromagnet 37 and instructs to perform dummy ejection against the ink receiving plate 33*a* of the partitioning plate 33 by driving the recording head 13*a* at the predetermined drive timing.

Consequently, it is possible to move the ink receiving plate 33*a* of the partitioning plate 33 to the gap between the recording surface of the thick recording medium Pb conveyed by the conveyance unit such as the belt conveyor 2 etc. and the recording head 13*a* at timing of dummy ejection and instruct the recording head 13*a* to perform dummy ejection. As a result, it is possible to perform dummy ejection of the recording head 13*a* that ejects ink droplets on the thick recording medium Pb quickly at appropriate timing.

The inkjet printer 10 in the inkjet printing system 1 in this embodiment performs an ink ejecting printing control method. The ink ejecting printing control method includes the steps of ejecting ink droplets on the recording surface by driving the recording head 13*a* that is laid out creating predetermined clearance against the recording surface of the conveyed recording medium Pb and has a predetermined recording length in the main scanning direction perpendicular to the conveyance direction of the recording medium Pb, moving the partitioning plate (partitioning member) 33 that is longer than the recording length of the recording head 13*a* and has a predetermined width in the conveyance direction in parallel with the recording surface between the position facing the recording head 13*a* and the retracted position away from the position facing the recording head, biasing the supporting arms (supporting member) 32*a* and 32*b* that supports the ink receiving plate 33*a* of the partitioning plate 33 movable between the position facing the recording head and the retracted position to the direction where the ink receiving plate 33*a* is located at the retracted position, moving the supporting arms 32*a* and 32*b* to the position where the ink receiving plate 33*a* of the partitioning plate 33 is located at the position facing the recording head against the biasing force, moving the ink receiving plate 33*a* to the position facing the recording head and instructs to perform dummy ejection against the ink receiving plate 33*a* at the predetermined drive timing.

Consequently, it is possible to move the ink receiving plate 33*a* of the partitioning plate 33 to the gap between the recording surface of the thick recording medium Pb and the recording head 13*a* at timing of dummy ejection and instruct the recording head 13*a* to perform dummy ejection. As a result, it is possible to perform dummy ejection of the recording head 13*a* that ejects ink droplets on the thick recording medium Pb quickly at appropriate timing.

The present invention also encompasses a non-transitory recording medium storing a program that executes a method of controlling ink ejecting printing. The method of controlling ink ejecting printing includes the steps of ejecting ink droplets on the recording surface by driving the recording head 13*a* that is laid out creating predetermined clearance against the recording surface of the conveyed recording medium Pb and has a predetermined recording length in the main scanning direction perpendicular to the conveyance direction of the recording medium Pb, moving the partitioning plate (partitioning member) 33 that is longer than the recording length of the recording head 13*a* and has a predetermined width in the conveyance direction in parallel with the recording surface between the position facing the recording head 13*a* and the retracted position away from the position facing the recording head, biasing the supporting arms (supporting member) 32*a* and 32*b* that supports the ink receiving plate 33*a* of the partitioning plate 33 movable between the position facing the recording head and the retracted position to the direction where the ink receiving plate 33*a* is located at the retracted position, moving the supporting arms 32*a* and 32*b* to the position where the ink receiving plate 33*a* of the partitioning plate 33 is located at the position facing the recording head against the biasing force, moving the ink receiving plate 33*a* to the position facing the recording head and instructs to perform dummy ejection against the ink receiving plate 33*a* at the predetermined drive timing.

Consequently, it is possible to move the ink receiving plate 33*a* of the partitioning plate 33 to the gap between the recording surface of the thick recording medium Pb and the recording head 13*a* at timing of dummy ejection and instruct the recording head 13*a* to perform dummy ejection. As a result, it is possible to perform dummy ejection of the recording head 13*a* that ejects ink droplets on the thick recording medium Pb quickly at appropriate timing.

Furthermore, in the inkjet printer 10 in the inkjet printing system 1 in this embodiment, the CPU 41 as the drive controller changes the drive timing as appropriate while the ink receiving plate 33*a* of the partitioning plate 33 is located at the position facing the recording head.

Consequently, it is possible to perform dummy ejection at different positions on the ink receiving plate 33*a* and prevent from forming ink clod at a specific position on the ink receiving plate 33*a* and getting the ink recording head 13*a* dirty when the ink receiving plate 33*a* moves. As a result, it is possible to enhance ink ejecting performance and improve image quality much more.

Figure 12:
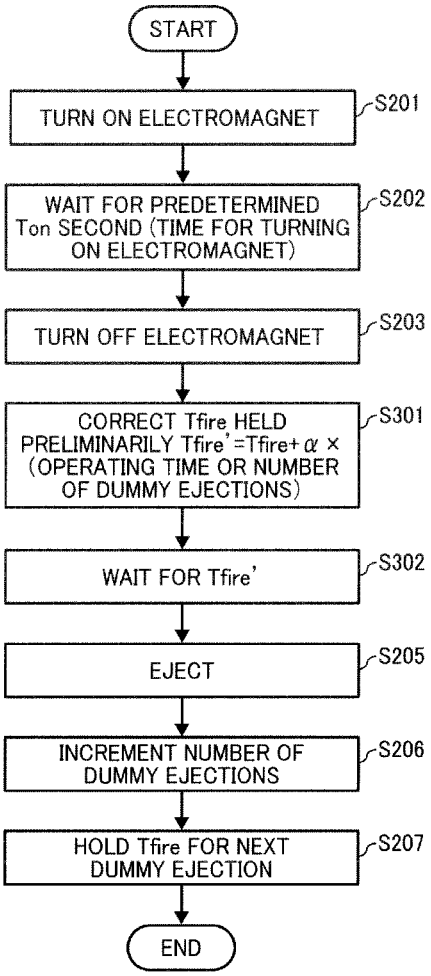
FIG. 12 is a flowchart illustrating a process of controlling dummy ejection considering spring deterioration as an embodiment of the present invention.

In the above description, assuming spring constant of the compression coil springs 35*a* and 35*b* is constant, the timing (dummy ejection start time $T_{fire}$) that sets the position of dummy ejection performed on the ink receiving plate 33*a* different each time is configured. However, the sprint constant of the compression coil springs 35*a* and 35*b* actually varies due to elapsed time and repetition of dummy ejection. To cope with this issue, for example, as shown in FIG. 12, the CPU (calculator) 41 can configure the dummy ejection start time $T_{fire}$ considering deteriorating state of the compression coil springs 35*a* and 35*b*. In FIG. 12, same steps as FIG. 11 have same step numbers, and descriptions for those steps are omitted.

That is, the CPU 41 first turns the electromagnet 37 on at timing of dummy ejection in S201 and keeps the electromagnet 37 turned on during the preset "on time" $T_{on}$ in S202. After turning the electromagnet 37 on for the "on time" $T_{on}$, the CPU 41 turns the electromagnet 37 off in S203 and calculates corrected dummy ejection start time $T_{fire}$ correcting the preset dummy ejection start time $T_{fire}$ in S301. The CPU 41 calculates the corrected dummy ejection start time $T_{fire}'$ by multiplying preset correction coefficient $\alpha$ and operating time or the number of dummy ejection ($\alpha\times$(operating time or the number of dummy ejection)) and adding the multiplying result to the dummy ejection start time $T_{fire}$.

After calculating the corrected dummy ejection start time $T_{fire}'$, and after the corrected dummy ejection start time $T_{fire}'$ elapses in S302, the CPU 41 performs dummy ejection by driving the recording head 13*a* in S205.

Next, in order to set the position of the next dummy ejection different from the position of the current dummy ejection, the CPU 41 increments the number of dummy ejections by one in S206. The CPU 41 reads the dummy ejection start time $T_{fire}$ for the next dummy ejection from the dummy ejection table Tb1 and stores it in the RAM 43 in S207.

As described above, the inkjet printer 10 in the inkjet printing system 1 in this embodiment further includes the CPU (calculator) 41 that calculates at least either one of the number of driving the electromagnet 37 as the moving unit and utilization time of the compression coil springs 35*a* and 35*b*. The CPU 41 as the drive controller corrects the driving time based on at least either one of the number of driving the electromagnet 37 and the utilization time of the compression coil springs 35*a* and 35*b* calculated by the CPU 41 as the calculator and drives the recording head 13*a* in accordance with the corrected drive timing.

Consequently, it is possible to adjust the drive timing of the recording head 13*a* depending on the degree of deterioration over time of the compression coil springs 35*a* and 35*b* as the biasing member and perform dummy ejection at different positions on the ink receiving plate 33*a* appropriately much more. As a result, it is possible to prevent from forming ink up at a specific position on the ink receiving plate 33*a* and getting the ink recording head 13*a* dirty when the ink receiving plate 33*a* moves. As a result, it is possible to enhance ink ejecting performance and improve image quality much more.

Second Embodiment

Figure 13:
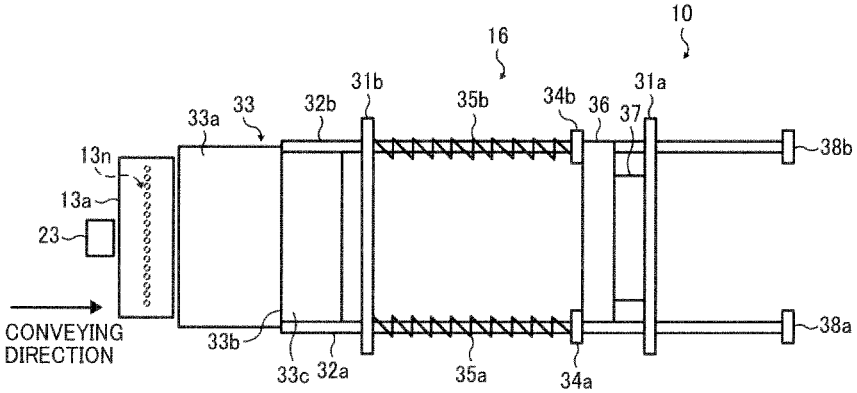
FIG. 13 is a plain diagram illustrating a maintenance unit as another embodiment of the present invention.

The second embodiment is described below with reference to from FIG. 13 to FIG. 16. FIG. 13 is a diagram illustrating the configuration of the maintenance unit 16 in the second embodiment.

The maintenance unit 16 in the second embodiment is similar to the one in the inkjet printer 10 in the inkjet printing system 1 of the first embodiment. In this embodiment, same signs are assigned to the configuration components same as the first embodiment, and description for those configuration components are omitted or simplified. In addition, same signs used in the first embodiment are used for components not shown in figures if necessary.

In FIG. 13, the inkjet printer 10 includes the same configuration as the first embodiment, and the inkjet printer 10 includes the maintenance unit 16 and the recording medium detection sensor 23 whose configurations are same as in the first embodiment.

In the inkjet printer 10, the recording medium detection sensor 23 is laid out in the upstream side of the recording head 13*a* in the conveyance direction of the recording medium Pb, The recording medium detection sensor (detector) detects the recording medium Pb as described above and the ink receiving plate 33*a*.

For example, a reflex optical sensor is used for the recording medium detection sensor 23, and the recording medium detection sensor 23 illuminates detection light in the direction of the belt conveyor 2 that transfers the recording medium Pb from a light emitting device and receives the reflected light by the light receiving device. The recording medium detection sensor 23 detects the recording medium Pb conveyed to the recording head 13*a* by the belt conveyor 2 and the ink receiving plate 33*a* of the partitioning plate 33 moved from the retracted position to the position facing the recording head and outputs the detecting result to the CPU 41.

Figure 14:
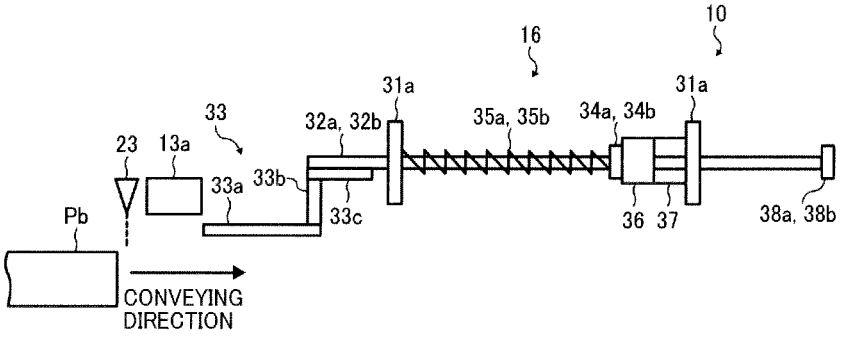
FIG. 14 is an elevational diagram illustrating a status that an ink receiving plate of the maintenance unit is located at a retracted position as another embodiment of the present invention.

That is, as shown in FIG. 14, in the inkjet printer 10, after the recording medium Pb is conveyed to the recording head 13*a* on the belt conveyor 2, the recording medium detection sensor 23 detects the recording medium Pb and outputs the detection signal to the CPU 41. The CPU 41 recognizes that the recording medium is conveyed based on the detection signal and controls printing an image on the recording medium Pb.

Figure 15:
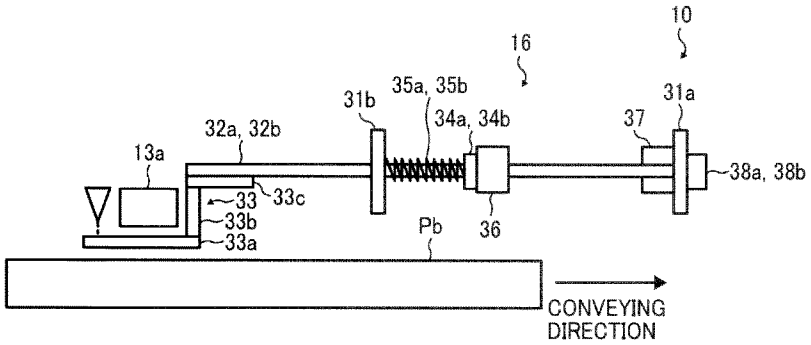
FIG. 15 is an elevational diagram illustrating a status that an ink receiving plate of the maintenance unit is located at a position facing the recording head as another embodiment of the present invention.

As shown in FIG. 15, in the inkjet printer 10, after the ink receiving plate 33*a* of the partitioning plate 33 moves from the retracted position to the position facing the recording head, the ink receiving plate 33*a* is detected, the detection signal is output to the CPU 41, and the CPU 41 controls timing of dummy ejection. That is, in the inkjet printer 10 in this embodiment, the ink receiving plate 33*a* is detected using the recording medium detection sensor 23 for detecting the recording medium Pb, and timing of dummy ejection is controlled.

Figure 16:
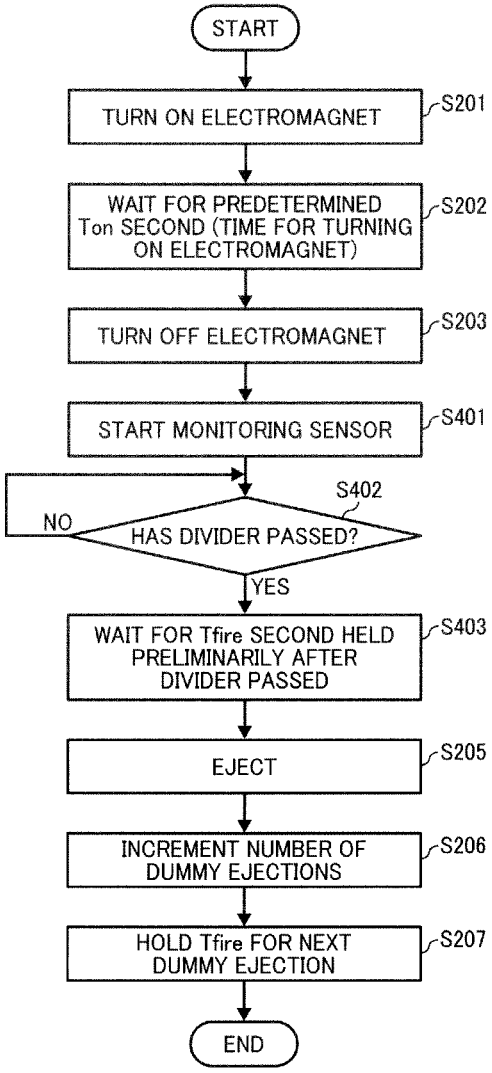
FIG. 16 is a flowchart illustrating a process of controlling dummy ejection as another embodiment of the present invention.

Next, the inkjet printer 10 in this embodiment performs the dummy ejection controlling process as shown in FIG. 2. In FIG. 16, same step numbers are assigned to steps same as in FIG. 11, and descriptions for those steps are omitted.

In FIG. 16, the CPU 41 first turns the electromagnet 37 on at timing of dummy ejection in S201 and keeps the electromagnet 37 turned on during the preset "on time" in S202. After turning the electromagnet 37 on for the "on time" $T_{on}$, the CPU 41 turns the electromagnet 37 off in S203 and starts monitoring the detection result of the ink receiving plate 33*a* using the recording medium detection sensor 23 in S401. That is, when the ink receiving plate 33*a* starts moving from the stopped position facing the recording head to the direction of the retracted position by the biasing force of the compression coil springs 35*a* and 35*b* after the electromagnet is turned off, the CPU 41 monitors if the edge of the ink receiving plate 33*a* passes through the mounting position of the recording medium detection sensor 23.

The CPU 41 checks if the edge of the ink receiving plate 33*a* of the partitioning plate 33 passes through the mounting position of the recording medium detection sensor 23 in S402 and waits until the edge of the ink receiving plate 33*a* passes through if the edge of the ink receiving plate 33*a* has not passed through the mounting position yet.

If the edge of the partitioning plate 33 passes through the mounting position of the recording medium detection sensor 23 (YES in S402), the CPU 41 waits until the dummy ejection start time $T_{fire}$ held preliminarily elapses after the partitioning plate 33 passes through in S403. That is, in the inkjet printer 10 in this embodiment, as the dummy ejection table associated with the number of dummy ejections and the dummy ejection start time $T_{fire}$ shown in FIG. 9, the dummy ejection table associated with the number of dummy ejections and the elapsed time from when the edge of the partitioning plate 33 passes through the recording medium detection sensor 23 as the dummy ejection start time $T_{fire}$ is stored in the ROM 42 etc.

After the leading edge of the partitioning plate 33 passes through and the dummy ejection start time $T_{fire}$ elapses, the CPU 41 performs dummy ejection by driving the recording head 13*a* in S205.

Next, in order to set the position of the next dummy ejection different from the position of the current dummy ejection, the CPU 41 increments the number of dummy ejections by one in S206. The CPU 41 reads the dummy ejection start time $T_{fire}$ for the next dummy ejection from the dummy ejection table Tb1 and stores it in the RAM 43 in S207. Consequently, the dummy ejection control process ends.

As described above, the inkjet printer 10 in the inkjet printing system 1 in this embodiment further includes the recording medium detection sensor (detector) 23 that detects the position of the ink receiving plate 33*a* in the partitioning plate 33, and the CPU 41 as the drive controller configures the driving time based on the position of the ink receiving plate 33*a* of the partitioning plate 33 detected by the recording medium detection sensor 23.

Consequently, it is possible to figure out the position of the ink receiving plate 33*a* of the partitioning plate 33 accurately and control dummy ejection of the recording head 13*a*. Therefore, it is possible to perform dummy ejection at different positions on the ink receiving plate 33*a* appropriately much more. As a result, it is possible to prevent from forming ink clod at a specific position on the ink receiving plate 33*a* and getting the ink recording head 13*a* dirty when the ink receiving plate 33*a* moves. As a result, it is possible to enhance ink ejecting performance and improve image quality much more.

In addition, in the inkjet printer 10 in the inkjet printing system 1 in this embodiment, the position of the ink receiving plate 33*a* is detected using the recording medium detection sensor 23 necessary for the inkjet printer 10 in the inkjet printing system 1.

Consequently, it is possible to figure out the position of the ink receiving plate 33*a* of the partitioning plate 33 reasonably and accurately and perform dummy ejection at different positions on the ink receiving plate 33*a* reasonably and appropriately.

Third Embodiment

Figure 17:
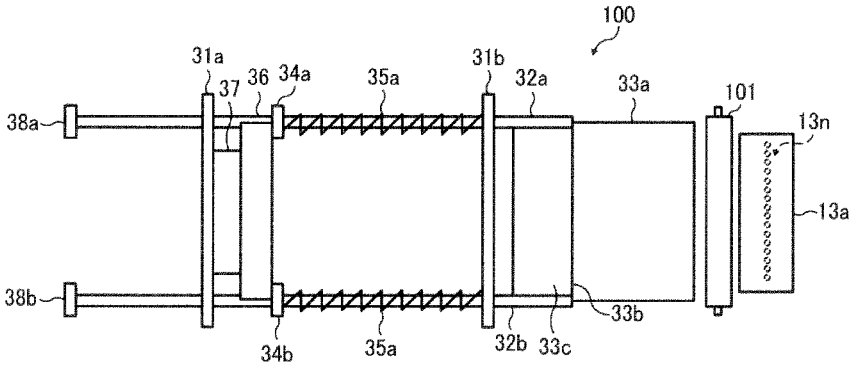
FIG. 17 is a plain diagram illustrating a maintenance unit as yet another embodiment of the present invention.

The third embodiment is described below with reference to from FIG. 17 to FIG. 19. FIG. 17 is a diagram illustrating the configuration of a maintenance unit 160 in the third embodiment.

The maintenance unit 160 in the second embodiment is similar to the one in the inkjet printer 10 in the inkjet printing system 1 of the first embodiment. In this embodiment, same signs are assigned to the configuration components same as the first embodiment, and description for those configuration components are omitted or simplified. In addition, same signs used in the first embodiment are used for components not shown in figures if necessary.

In FIG. 17, the maintenance unit 160 includes the same configuration as the maintenance unit 16 in the first embodiment and further includes a cleaning roller 101.

The cleaning roller (removing unit) 101 removes ink attached on the surface of the ink receiving plate 33*a* when the ink receiving plate 33*a* of the partitioning plate 33 moves between the retracted position and the position facing the recording head and cleans the surface of the ink receiving plate 33*a* facing the recording head 13*a*.

In this embodiment, the cleaning roller 101 is laid out at a position between the edge of the ink receiving plate 33*a* facing the recording head 13*a* and the recording head 13*a*. The cleaning roller 101 is also laid out at a position where the bottom side of the cleaning roller 101 contacts the surface of the ink receiving plate 33*a* facing the recording head 13*a* closely as the ink receiving plate 33*a* moves. Any appropriate mechanism and material that can remove ink on the ink receiving plate 33*a* can be used for the cleaning roller 101. For example, cloth or spiral blade etc. can be used for the cleaning roller 101.

Figure 18:
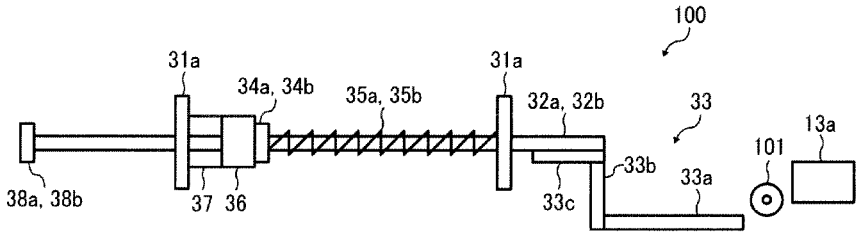
FIG. 18 is an elevational diagram illustrating a status that an ink receiving plate of the maintenance unit is located at a retracted position as yet another embodiment of the present invention.
Figure 19:
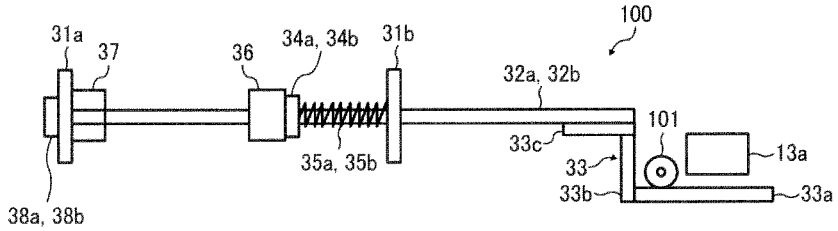
FIG. 19 is an elevational diagram illustrating a status that an ink receiving plate of the maintenance unit is located at a position facing the recording head as yet another embodiment of the present invention.

In the inkjet printer 10, if the CPU 41 turns the electromagnet 37 on and off to perform dummy ejection, the ink receiving plate 33*a* of the partitioning plate 33 moves reciprocally between the retracted position and the position facing the recording head via the supporting arms 32*a* and 32*b* as shown in FIGS. 18 and 19.

In the inkjet printer 10, when the ink receiving plate 33*a* moves reciprocally between the retracted position and the position facing the recording head, the cleaning roller 101 contacts the surface of the ink receiving plate 33*a* facing to the recording head 13*a* and removes ink attached on the ink receiving plate 33*a* by dummy ejection. Especially, on the homeward moving, ink can be removed effectively since ink that has been just ejected and not dried yet is attached.

As described above, in the inkjet printer 10 in the inkjet printing system 1 in this embodiment, the cleaning roller (removing unit) 101 that removes ink ejected on the ink receiving plate 33*a* by dummy ejection of the recording head 13*a* as the ink receiving plate 33*a* of the partitioning plate 33 moves between the retracted position and the position facing the recording head is laid out.

Consequently, it is possible to prevent image quality of a printed image from deteriorating because ink ejected on the ink receiving plate 33*a* by dummy ejection does not attach to the recording head 13*a* etc.

Fourth Embodiment

Figure 20:
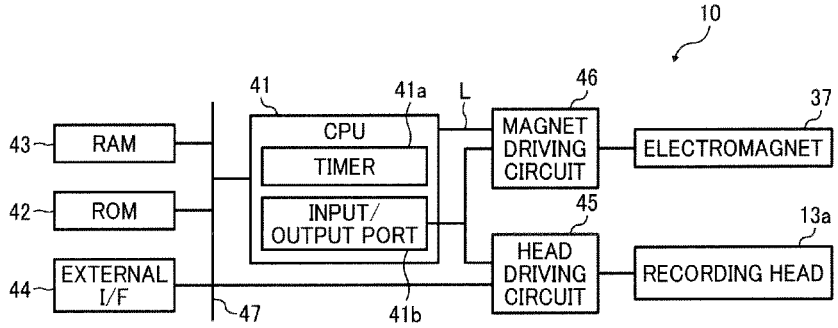
FIG. 20 is a block diagram illustrating a substantial part of the inkjet printer that controls drive power of an electromagnet.

The fourth embodiment is described below with reference to from FIG. 20 to FIG. 21. FIG. 20 is a diagram illustrating a substantial part of the inkjet printer 10 in the fourth embodiment.

The inkjet printer 10 in the fourth embodiment is similar to the inkjet printer 10 in the inkjet printing system 1 of the first embodiment. In this embodiment, same signs are assigned to the configuration components same as the first embodiment, and description for those configuration components are omitted or simplified. In addition, same signs used in the first embodiment are used for components not shown in figures if necessary.

As shown in FIG. 20, in the inkjet printer 10 in this embodiment, a control signal line L is connected between the CPU 41 and the magnet driving circuit 46, and the CPU 41 instructs the magnet driving circuit 46 to control driving force of the electromagnet 37.

Figure 21:
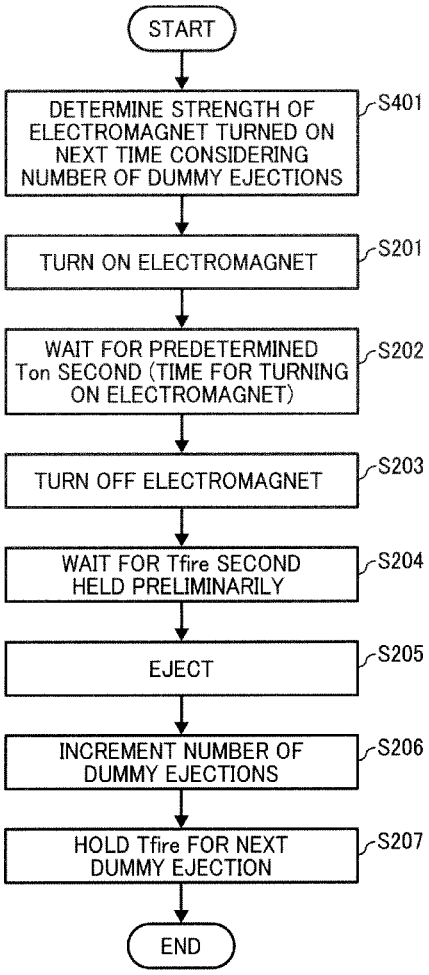
FIG. 21 is a flowchart illustrating a process of controlling dummy ejection that controls drive power of the electromagnet.

That is, in the inkjet printer 10, as shown in FIG. 21, in case of performing dummy ejection controlling process, first, the CPU 41 determines driving force to drive the electromagnet 37 based on the number of dummy ejections when the electromagnet 37 is turned on next time in S401.

For example, in the inkjet printer 10, strength configuration information that enhances strength of the electromagnet 37 in performing dummy ejection is stored in the ROM 42 etc. preliminarily. After reading the strength configuration information from the ROM 42 etc., the CPU 41 controls the driving force signal output to the magnet driving circuit 46 via the control signal line L based on the strength configuration information. For example, in case of driving the electromagnet 37 at strength stronger than normal strength only once in predetermined times, the predetermined times (e.g., five times) and values of driving force at the normal strength and the stronger strength are registered in the strength configuration information. If the strength configuration information described above is registered, the CPU 41 counts the number of dummy ejections. If the counted number of dummy ejections is equal to multiple of preset numbers (e.g., multiple of five), the CPU 41 outputs the strength control signal that sets the strength of the electromagnet 37 stronger as configured to the magnet driving circuit 46 via the control signal line L.

After determining the strength of the electromagnet 37, the CPU 41 outputs the strength control signal to the magnet driving circuit 46 via the control signal line L. Simultaneously, the CPU 41 outputs the driving signal via the input/output port 41*b* and turns the electromagnet 37 on at the strength indicated by the strength control signal via the magnet driving circuit 46 in S201.

As described above, after turning the electromagnet 37 on, the CPU 41 keeps the electromagnet 37 turned on during the preset "on time" $T_{on}$ in S202. After turning the electromagnet 37 on for the "on time" $T_{on}$, the CPU 41 turns the electromagnet 37 off in S203 and waits the preset dummy ejection start time $T_{fire}$ elapse in S204.

After the electromagnet 37 is turned off and the dummy ejection start time $T_{fire}$ elapses, the CPU 41 performs dummy ejection by driving the recording head 13*a* in S205.

Next, in order to set the position of the next dummy ejection different from the position of the current dummy ejection, the CPU 41 increments the number of dummy ejections by one in S206. The CPU 41 reads the dummy ejection start time $T_{fire}$ for the next dummy ejection from the dummy ejection table Tb1 and stores it in the RAM 43 in S207. Consequently, the dummy ejection control process ends.

In this case, even if the ink receiving plate 33*a* is interfered in moving because ink ejected on the ink receiving plate 33*a* by dummy ejection is dried out, gets solidified, and contacts the recording head 13*a*, the issue can be solved by driving the electromagnet 37 by the stronger strength.

As described above, in the inkjet printer 10 in the inkjet printing system 1 in this embodiment, the CPU 41 as the drive controller drives the electromagnet 37 as the moving unit by making the driving force stronger with appropriate strength at predetermined times.

Consequently, even if ink ejected on the ink receiving plate 33*a* by dummy ejection becomes clod and interferes with the recording head 13*a*, it is possible to move the ink receiving plate 33*a* to the position facing the recording head facing to the recording head 13*a* appropriately. As a result, it is possible to perform dummy ejection appropriately.

Numerous additional modifications and variations are possible in light of the above teachings. It is therefore to be understood that, within the scope of the appended claims, the disclosure of this patent specification may be practiced otherwise than as specifically described herein. For example, it is possible that the image forming apparatus includes the document holding determination unit only. Alternatively, it is possible that the image forming apparatus includes the document holding determination unit and any one of or any combination of the rangefinder, the user authentication unit, the recovery processor, the print job acquisition unit, the auxiliary parameter setting unit, and the facsimile number setting unit.

As can be appreciated by those skilled in the computer arts, this invention may be implemented as convenient using a conventional general-purpose digital computer programmed according to the teachings of the present specification. Appropriate software coding can readily be prepared by skilled programmers based on the teachings of the present disclosure, as will be apparent to those skilled in the software arts. The present invention may also be implemented by the preparation of application-specific integrated circuits or by interconnecting an appropriate network of conventional component circuits, as will be readily apparent to those skilled in the relevant art.

Each of the functions of the described embodiments may be implemented by one or more processing circuits. A processing circuit includes a programmed processor, as a processor includes circuitry. A processing circuit also includes devices such as an application specific integrated circuit (ASIC) and conventional circuit components arranged to perform the recited functions.

What is claimed is:

1. An ink ejecting printer, comprising:

a recording head disposed with a prescribed clearance between the recording head and a recording surface of a recording medium being conveyed, having a predetermined recording length in a main scanning direction perpendicular to a conveyance direction of the recording medium, and configured to eject an ink droplet on the recording surface;

a partitioning member having a length longer than the recording length of the recording head, having a predetermined width in the conveyance direction, and movable between a position facing the recording head and a retracted position away from the position facing the recording head in parallel with the recording surface between the recording head and the recording surface;

a supporting member to support the partitioning member so as to be movable between the position facing the recording head and the retracted position;

a biasing unit to bias the supporting member toward the partitioning member located at the retracted position;

a moving unit to move the supporting member toward the partitioning member located at the position facing the recording head against biasing force of the biasing unit; and a drive controller to drive the moving unit to move the partitioning member to the position facing the recording head and drive the recording head at predetermined drive timing to cause the recording head to eject an ink droplet on the partitioning member by performing dummy ejection.

2. The ink ejecting printer according to claim 1, wherein the drive timing is changed when the partitioning member is located at the position facing the recording head.

3. The ink ejecting printer according to claim 1, further comprising a calculating unit to calculate at least one of a number of times the moving unit is driven and utilization time of the biasing member, wherein the drive controller corrects the drive timing based on at least one of the number of times the moving unit is driven and utilization time of the biasing member and drives the recording head at the corrected drive timing.

4. The ink ejecting printer according to claim 1, further comprising a detector to detect a position of the partitioning member, wherein the drive controller configures the drive timing based on the position of the partitioning member detected by the detector.

5. The ink ejecting printer according to claim 1, further comprising a removing member that removes the ink that the recording head ejects on the partitioning member by dummy ejection as the partitioning member moves between the retracted position and the position facing the recording head.

6. The ink ejecting printer according to claim 1, wherein the drive controller drives the moving unit at different velocities.

7. The ink ejecting printer according to claim 1, wherein the biasing member is a spring, and the moving unit is an electromagnet.

8. An ink ejecting printing system, comprising:

a conveyance unit to convey a recording medium at constant velocity; and an ink ejecting printer to record an image by ejecting an ink droplet onto a recording surface of the recording medium conveyed by the conveyance unit in a stationary state, wherein the ink ejecting printer includes:

a recording head disposed with a prescribed clearance between the recording head and a recording surface of a conveyed recording medium, having predetermined recording length in a main scanning direction perpendicular to a conveyance direction of the recording medium, and ejecting an ink droplet on the recording surface;

a partitioning member longer than the recording length of the recording head, having a predetermined width in the conveyance direction, and movable between a position facing the recording head and a retracted position away from the position facing the recording head in parallel with the recording surface between the recording head and the recording surface;

a supporting member to support the partitioning member movable between the position facing the recording head and the retracted position;

a biasing unit to bias the supporting member toward the partitioning member located at the retracted position;

a moving unit to move the supporting member toward the partitioning member located at the position facing the recording head against biasing force of the biasing unit; and a drive controller to move the partitioning member to the position facing the recording head by driving the moving unit and instruct the recording head to eject an ink droplet on the partitioning member by performing dummy ejection by driving the recording head at predetermined drive timing.

9. A method of controlling ink ejecting printing, the method comprising the steps of:

driving a recording head with a prescribed clearance between the recording head and a recording surface of a conveyed recording medium, having a predetermined recording length in a main scanning direction perpendicular to a conveyance direction of the recording medium, and ejecting an ink droplet on the recording surface;

moving a partitioning member being longer than the recording length of the recording head with a predetermined width in the conveyance direction between a position facing the recording head and a retracted position away from the position facing the recording head in parallel with the recording surface between the recording head and the recording surface;

biasing a supporting member supporting the partitioning member movable between the position facing the recording head and the retracted position toward the partitioning member located at the retracted position;

moving the supporting member toward the partitioning member located at the position facing the recording head against biasing force of a biasing unit; and moving the partitioning member to the position facing the recording head by driving a moving unit and instructing the recording head to eject an ink droplet on the partitioning member by performing dummy ejection by driving the recording head at predetermined drive timing while the partitioning member is located at the position facing the recording head.

10. A non-transitory, computer-readable recording medium storing a program that, when executed by a processor, causes the processor to implement a method of controlling ink ejecting printing, the method comprising the steps of:

driving a recording head with a prescribed clearance between the recording head and a recording surface of a conveyed recording medium, having a predetermined recording length in a main scanning direction perpendicular to a conveyance direction of the recording medium, and ejecting an ink droplet on the recording surface;

moving a partitioning member being longer than the recording length of the recording head with a predetermined width in the conveyance direction between a position facing the recording head and a retracted position away from the position facing the recording head in parallel with the recording surface between the recording head and the recording surface;

biasing a supporting member supporting the partitioning member movable between the position facing the recording head and the retracted position toward the partitioning member located at the retracted position;

moving the supporting member toward the partitioning member located at the position facing the recording head against biasing force of a biasing unit; and moving the partitioning member to the position facing the recording head by driving a moving unit and instructing the recording head to eject an ink droplet on the partitioning member by performing dummy ejection by driving the recording head at predetermined drive timing while the partitioning member is located at the position facing the recording head.

* * * * *